United States Patent [19]

Zuckerman et al.

[11] 4,424,922

[45] Jan. 10, 1984

[54] RESHAPABLE THREE DIMENSIONAL PLASTIC GARMENT HANGER

[76] Inventors: Jack M. Zuckerman; Andrew M. Zuckerman, both of 110-11 Queens Blvd., Forest Hills, N.Y. 11375

[21] Appl. No.: 381,061

[22] Filed: May 24, 1982

[51] Int. Cl.[3] ..... A47J 51/096

[52] U.S. Cl. ..... 223/88

[58] Field of Search ..... 223/85, 88, 92, 95, 223/68; D6/247, 248, 249, 250, 256; 403/2

[56] References Cited

U.S. PATENT DOCUMENTS

| | | | |
|---|---|---|---|
| 1,828,975 | 10/1931 | Magarian | 223/88 |
| 2,367,891 | 1/1945 | Sander | 223/68 |
| 3,429,199 | 2/1969 | Kenyon | 403/2 X |
| 3,693,283 | 9/1972 | Marcus | 223/68 |

FOREIGN PATENT DOCUMENTS

| | | | |
|---|---|---|---|
| 557427 | 5/1957 | Belgium | 223/88 |

*Primary Examiner*—Werner H. Schroeder
*Assistant Examiner*—Andrew M. Falik
*Attorney, Agent, or Firm*—Bauer & Amer

[57] ABSTRACT

A three dimensional plastic garment hanger is molded with an original shape for the display of a garment, but is reshapeable at the site of the display of the attractive details of other garments, as the need arises. The garment hanger includes selectively releasable connections that retain the garment hanger in its originally molded three dimensional shape with front and rear sections fixed from relative movement. The invention further includes a method of making the hanger to enable the same to be reshaped to that of different garments at the site of display of such garments.

19 Claims, 21 Drawing Figures

RESHAPABLE THREE DIMENSIONAL PLASTIC GARMENT HANGER

The present invention relates to three dimensional plastic garment hangers and more particularly to garment hangers and a method of making such hangers that are changeable from their original molded shape to another shape that enables the same to display the attractive details of different garments.

It has been the practice to display garments on hangers as forms, mannequins and the like so the attractive details of the garments may be more fully displayed to the potential customer as disclosed in co-pending United States patent application Ser. No. 014,053 filed Feb. 22, 1979. When it is desired to display a garment of a size or shape different than the given size or shape for which the mannequin or form was originally made, it is necessary to change the garment to fit such hanger, form or mannequin rather than to adapt the hanger, form or mannequin to that of the garment.

This means that the overall appearance of the garment must be changed or altered to fit the hanger. When this is done, the garment no longer exhibits or shows its original details in the manner it was designed. Additionally, the purpose for which the garment hanger was made is now defeated and the benefits of the attractive details of design of the garment are obscured and hidden from view because the garment must be adapted for use with a hanger that was not made for the display of the garment. This problem results from the long accepted concept and idea that hangers are made fixed in size and shape and that the garment must be adapted to the hanger rather than to reshape and change the hanger to fit the garment without distortion to display its attractive details.

Hence, hanger designers have long overlooked the true function of a hanger, namely, to be adapted to the garment rather than vice versa. Thus, it is not uncommon, even in the best and most expensive stores and shops, to see beautiful garments with attractive and stunning details hidden from view by tucks and gatherings and pins that mar their appearance in order to hold the garment to the hanger. The result causes the garment to assume the shape of the hanger rather than to enable the garment to retain its original attractive ornamental shape.

This has been especially true in respect of the display of children's garments and in particular small garments in the range of sizes 2 to 6X. The reason for this is that garments in such small sizes vary greatly in appearance and shape. For example, some such garments may be almost tailored with very little flare below the waist. Other children's garments may have flared skirts while still others may be provided with an extended and even exaggerated bouffant appearance at the skirt, almost at times resembling a tutu.

To properly display the attractive details of this wide and varied array of garments has required numerous separate hangers, each one molded or shaped to that of the respective garment so as to enable it to display the details of its respective garment. Garment manufacturers and hanger manufacturers have found that making the required number of hangers of differing sizes and shapes is uneconomical and unusually expensive, especially with the rapid changes in garment styles.

As a consequence, attempts at providing display hangers for garments in this small size range have required that the hangers be handmade or custom-made to the shape of the garment. Even then the hand crafted form or hanger was not made to fit or correspond to and fully display the details of the garment with which it is used. In such cases the window dresser or display person then resorts to the old practice of pinning gathers and tucks to force the garment to assume the shape of the hanger that hide and distort the garment's original design.

The present invention avoids the aforedescribed problems of the prior art including the co-pending application Ser. No. 014,053 referred to above. The desideratum of the present invention is to provide a garment hanger which, in its simplest form, accommodates garments in children's size ranges of 2 to 6X, although not limited thereto, and displays their original decorative appearance. Unlike prior art hangers, hangers constructed according to the teaching of the present invention are enabled to perform their intended functions and may be altered, changed and reshaped to correspond to and fit the attractive details of the garment, rather than forcing the garment to be configured to that of the hanger.

The present invention teaches a garment hanger and a method of making the same so as to enable it to accommodate garments of different sizes and shapes without requiring changes in the garment to fit the hanger. It is within the teaching of the present invention that a hanger of basic construction will perform the universal functions required of it to display the attractive shapes of differently sized children's clothing hung thereon. The teaching of the present invention, as it relates to the discussion of children's clothing, is equally applicable to the use of a hanger that may be made for adult's clothing.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein:

FIG. 4 is a front elevation of the hanger of FIG. 1 showing the same changed in shape after the release of certain of the connections according to the teaching of the invention; while

Figure 1:
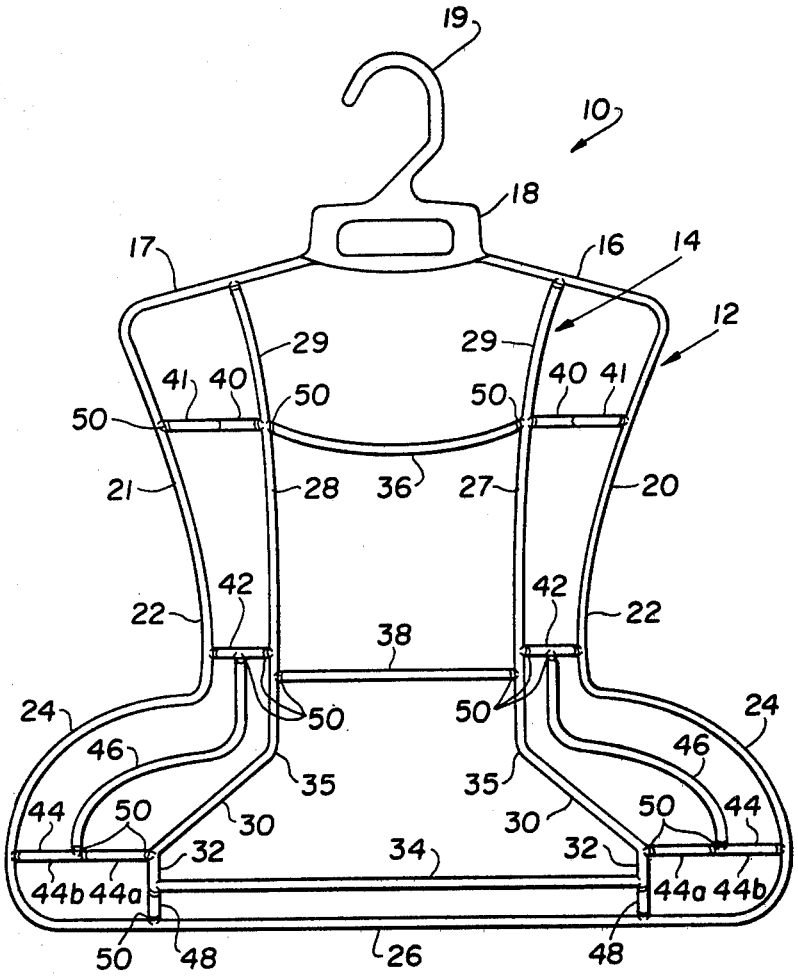
FIG. 1 is a front elevational view of a three dimensional garment hanger constructed according to the teaching of the invention.
Figure 2:
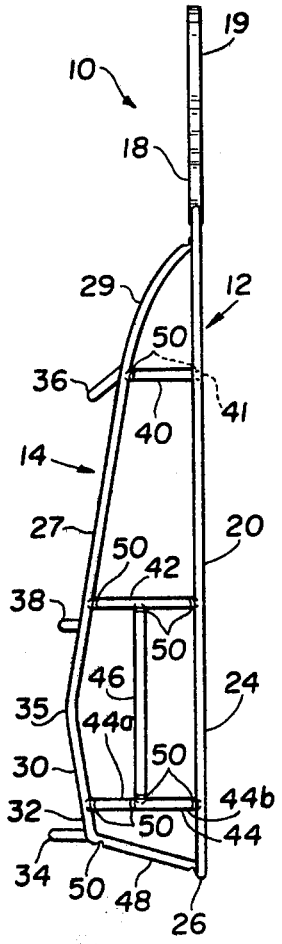
FIG. 2 is a side view of FIG. 1.
Figure 3:
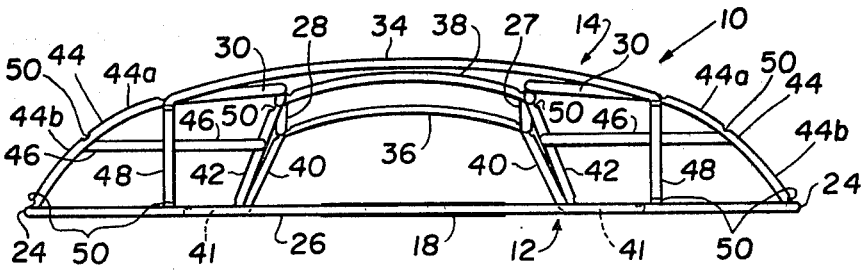
FIG. 3 is a bottom view of FIG. 1.

Referring to the drawings and more particularly to FIGS. 1, 2 and 3 thereof, the garment hanger thereshown is generally identified by the numeral 10. For convenience of discussion and illustration of the invention, the garment hanger 10 hereshown and hereinafter discussed is adapted especially to display the attractive details of children's garments, more especially in sizes ranging from 2 to 6X. It will be apparent to those skilled in the art that the teaching of this invention may be applied to garment hangers, forms, mannequins and the like suitable for use with other garments and of different sizes. The reference hereafter to the terms garment hanger or hanger or the plural thereof is intended to include other forms of garment supports and displays such as mannequins, open and closed forms for supporting and hanging garments, and the like.

The garment hanger 10 is illustrated in a simplified form as shown in FIGS. 1 to 3. The simplified form of the garment hanger 10 is made of plastic material that is initially or originally molded with a rear section generally identified by the numeral 12 and a front section generally identified by the numeral 14 as is seen more clearly in FIGS. 2 and 3. The rear section 12 may include a pair of oppositely disposed shoulder supports 16 and 17 that extend in a sloping direction downward from a collar 18 that is formed during the molding operation integral with a hook 19 that is used to hang and suspend the hanger 10 from any convenient rack or other support.

Each of the downwardly sloping shoulders 16 and 17 merge with downwardly depending sides 20 and 21 respectively that include waist delineating portions 22. Each side 20 and 21 also includes a laterally outward flared extension 24 that curves downward smoothly to merge and be formed unitary and integral with a bottom closure crossbar 26.

The front section 14 is molded integral and unitary with the rear section 12 and includes a pair of oppositely disposed and relatively spaced sides 27 and 28. The sides are connected at their upper portions with the respective shoulders 16 and 17 at points intermediate the ends of such shoulders laterally outward of the collar 18 and inward of the merger of the shoulders with their respective sides 20 and 21.

The sides 27 and 28 project forwardly and downwardly from their respective shoulders in an outward forward bowed configuration as is illustrated and seen more clearly in FIG. 2 and indicated by the numeral 29. The bowed shape identifies and indicates the garment chest or bust supporting and shaping portion of the garment hanger. The sides 27 and 28 continue in their downward depending direction from their jointure with their respective shoulders and are directed forwardly in a spaced relationship from the rear sides 20 and 21 so that the space becomes increasingly greater as the sides 27 and 28 continue in their downward extension from the shoulders.

The sides 27 and 28 are directed laterally inward and closer toward each other at their lower portions than they are at their connections with the shoulders 16 and 17. They merge at their lower ends with laterally outward directed sloping supports 30, each of which terminates in a straight side 32, and each said side is connected together at the base thereof by a bottom closure crossbar 34.

By referring to FIGS. 1 and 2 it will be seen that at the approximate point 35 of merger between the sides 27 and 28 with their respective sloping supports 30, the garment flares or sloping supports 30 of the front section 14 are bent back in a direction toward the rear section 12. From viewing FIGS. 2 and 3, it will be seen that the bottom closure or crossbar 34 connected between the straight sides 32 assumes an outward bowed configuration in a direction forward of and away from the rear section 12 as is more clearly seen in FIG. 3.

At the vicinity of the chest or bust 29 the sides 27 and 28 are essentially connected together from substantial relative movement by an arcuately shaped connecting rib 36. The rib 36 bows outward and forward of the front section 14 as can be seen more clearly in FIGS. 2 and 3. It also bows downward sightly from its connecting sides to a lowered point toward its middle in the direction of the bottom of the garment hanger 10. The relative spacing of the sides 27 and 28 is further maintained in the area of the waist thereof by a waist connecting rib 38 that, like the bust area or chest rib 36, is bowed forward and outward away from the connected sides in the manner as is illustrated more clearly in FIGS. 2 and 3.

The rear and front sections 12 and 14 are maintained in their relative spaced relationship and the sides thereof are interconnected relative to each other by a plurality of connecting, but detachable or separable struts. For example, in the upper portion of the garment hanger 10 in the area of the bust or chest thereof the sides 20 and 27 are joined together by a compound connecting strut that is formed with a transverse leg 40 and a substantially horizontal leg 41, both of which are unitarily formed to define the single strut. Each end of the strut 40, 41 is joined and formed integral with and as a monolithic part of the sides 27 and 20. In like manner a similar combined strut 40 and 41 joins together the sides 21 and 28 to maintain the same in relative spaced relationship on the opposite side of the bust or chest area of the garment hanger 10.

In the area of the waist of the garment hanger the sides 27 of the forward section and the waist delineating portion 22 of the rear section 12 of the garment hanger are joined together and maintained in relative spaced relationship by a strut 42. A similar strut 42 is connected between the side 28 of the front section 14 and the waist delineating portion 22 of the rear section 12 in the manner as aforedescribed.

The flared portions 24 and 30 of the rear and front sections of the hanger respectively are maintained in their originally molded form and relative spacing by flare connecting struts 42 and the flare connecting struts 44. Extending between the waist connecting struts 42 and the flare connecting struts 44 is an intermediate flared section 46. The intermediate flared section 46 serves to reduce the transverse space that is normally defined between the flared portions 24 and 30 of the respective rear and front sections 12 and 14. Thus, the intermediate flared sections 46 provide additional supports for a garment so as to shape the garment thereat and prevent the garment from falling unwantedly into the space between the rear and front flares 24 and 30 respectively.

At the lower portion of the monolithic garment hanger 10 the rear and front sections 12 and 14 are interconnected from relative movement by bottom connecting struts 48 that are joined between the crossbar 26 of the rear section 12 and at the point of merger between the straight sides 32 and the bottom closure crossbar 34 of the forward or front section 14.

The garment hanger 10 as described above is initially formed as a unitary or monolithic molded structure with each of the details of structure integrally connected with the other so as to retain each of the connected parts from substantial and undesired relative movement out of their initially molded shape. However, as will be noted from the illustration in the drawings the connecting struts, ribs and sides are wireform in shape. That is to say, that they are relatively thin in cross section and, therefore, function essentially to define wire-like connections between the parts with which they are molded.

These connections, however, are intended to be readily detached to enable the connecting struts and ribs to be separated at their points of connection or to be separated at selected points along their lengths. When so doing they permit the hanger to be reshaped and changed to any desired shape or new configuration so that the hanger may be adapted to fill out and mold the attractive details of a garment so as to cause the garment to assume the shape it was originally intended to display by the designer of such garment.

To this end it has been found convenient to manufacture the garment hanger of a plastic material that bends and readily deforms to assume a new shape. Thermoplastic materials have been found unusually well adapted for this purpose. This is especially true when the portions of the garment hanger that are intended to be reshaped or changed in contour are made of a relatively thin cross section. Hence, although it is within the concept of present invention that certain parts of the hanger that are not normally susceptible of reshaping may be of a thicker or heavier material, it will be recognized by those who are skilled in the art that those parts of the hanger that are intended to be reshaped are more easily and better constructed of a smaller cross section such that they may be bent without breaking. This will enable them to retain their reshaped or changed form if the same are made of a heat responsive thermoplastic material that may be heated to permit them to be bent to their new shape and then cooled so as to retain their new shape without the need for external aids or mechanical devices.

Figure 4:
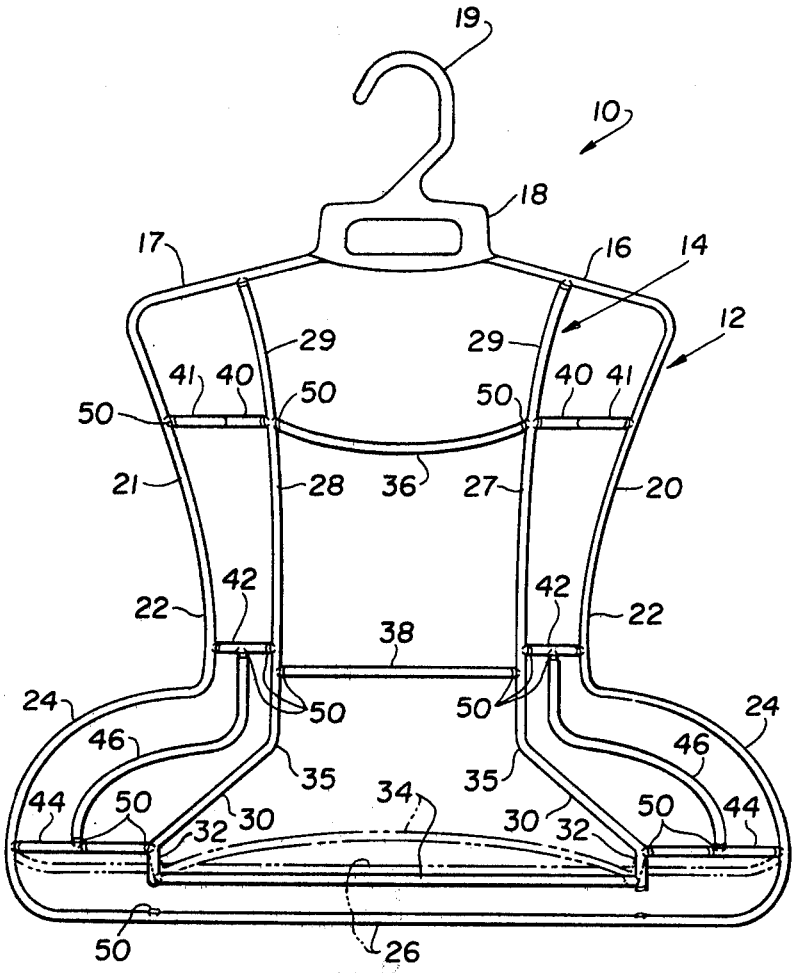
Figure 5:
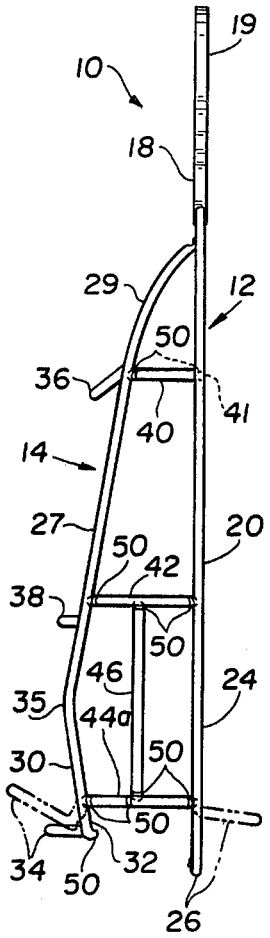
FIGS. 5 and 6 show the side and bottom views respectively thereof.
Figure 6:
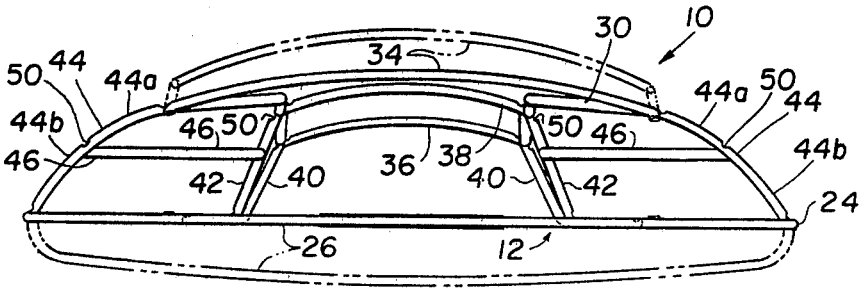

Referring now to the construction shown in FIGS. 4, 5 and 6, the garment hanger 10 shows one form of reshaping after the release of the struts 48. In referring to FIGS. 4, 5 and 6, it will be seen that the struts 48 have been released and, for convenience, fully removed from their interconnections between the lower or bottom portion of the front section 14 and the bottom closure crossbar 26 of the rear section 12. When such struts are released as is shown, the bottom closure crossbar 34 of the front section is now enabled to be reshaped. In like manner the bottom closure bar 26 of the rear section 12 is capable of being reshaped.

In the present illustration the reshaping of such crossbars may be done selectively in accordance with the needs of the garment to be displayed on the garment hanger 10. However, the reader's attention is brought to the illustration of FIGS. 5 and 6 wherein the bottom closure crossbar 26 of the rear section 12 has been bent from the original solid line position into the broken line position as shown in FIG. 5 illustrating the ability to bow outward and rearward the flared skirt of a child's garment while the bottom closure crossbar 34 of the front section 14 has been bent upward into an extreme position as shown by the broken lines in FIGS. 4, 5 and 6 so as to cause a child's skirt positioned thereover to bow forward to illustrate the pleats and details thereof.

Figure 7:
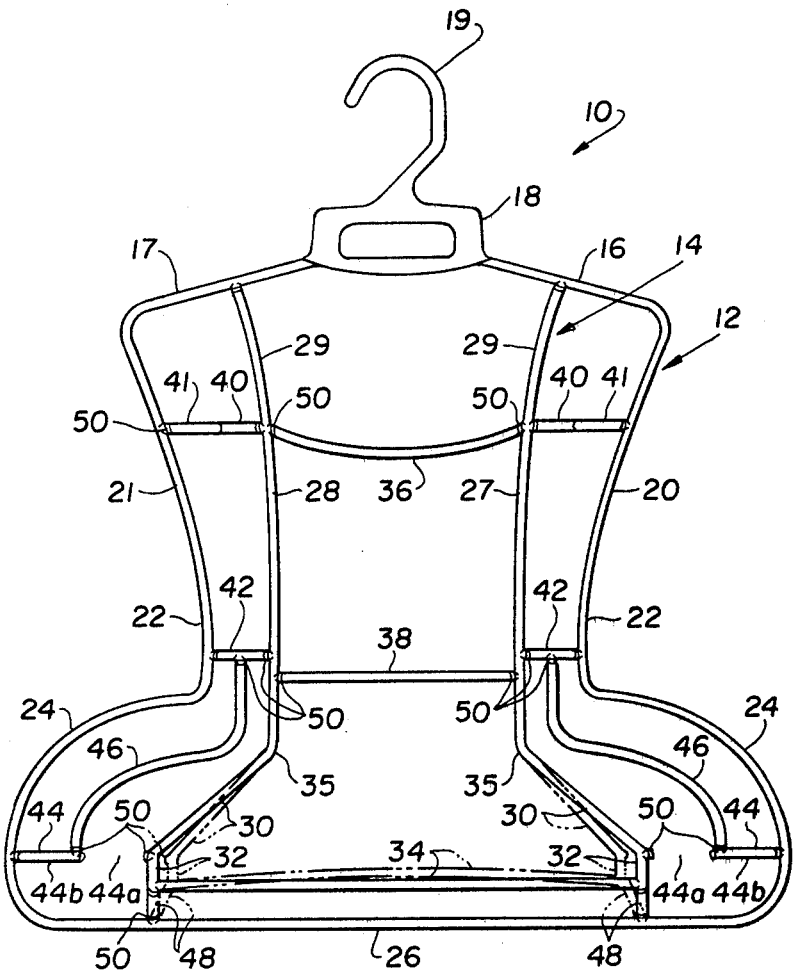
FIGS. 7, 8 and 9 are front, side and bottom views of the hanger of FIG. 1 changed in shape according to the invention after the selected release of different ones of the connections.
Figure 8:
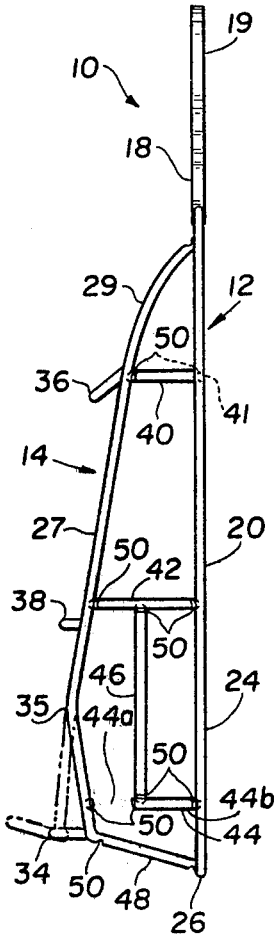
Figure 9:
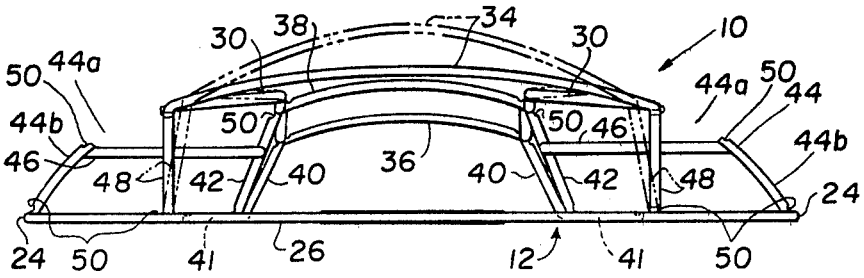

In referring to the illustrations of FIGS. 7, 8 and 9, it will be seen that a portion of the strut 44 connected between the intermediate flared section 46 and the flared supports 30 of the front section 14 of the hanger have been removed. The removal of only a portion of the struts 44 demonstrates the versatility of the present invention in that by the simple removal or release of only portions of whole struts or ribs the release of the interconnected elements of the garment hanger is now permitted to be rechanged and reshaped to cause the garment hanger to assume a garment supporting configuration completely different from that in which the garment hanger had originally been molded.

Thus, the illustration of FIGS. 7, 8 and 9 demonstrates that the release of a portion of the connecting struts 44 enables the flared sloping supports 30 of the front section 14 to be bent forward and away from the rear section 12 to impart to the garment hung thereover a full sweeping effect at the skirt and hemline thereof. The changed configuration of the flared sloping supports 30 from their initial solid line position is illustrated by the broken lines shown in FIGS. 7, 8 and 9.

As noted before the relative thinness and flexibility of the details of construction of the sides 27 and 28 at the lower portions thereof permits them to be bent readily without breaking and to cause them to assume any desired shape without distortion or cracking of the plastic. This distortion and reshaping of the hanger is enhanced when the plastic parts to be bent are first heated and after they are bent into their desired shape, are permitted to cool so as to retain their new configuration. FIG. 9 more clearly illustrates the released or detached portion of the strut 44 as shown by the open space **44*a***.

Figure 10:
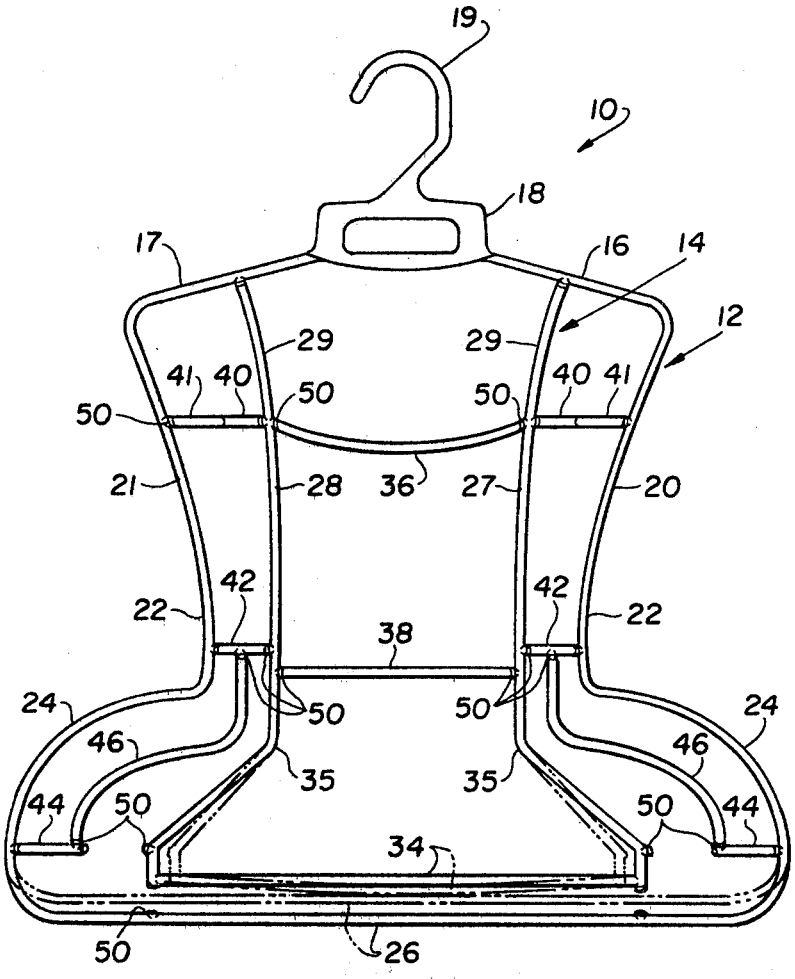
FIGS. 10, 11 and 12 are front, side and bottom views respectively of the hanger of FIG. 1 with different connections released to illustrate another change in shape of the hanger.
Figure 11:
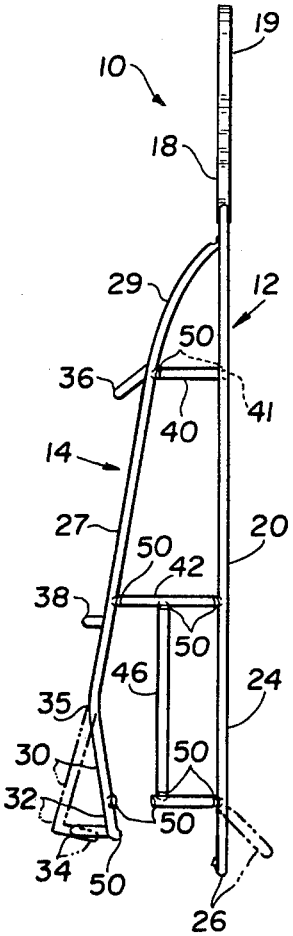
Figure 12:
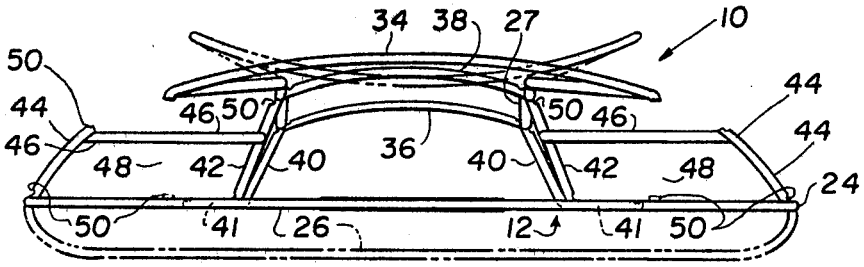

The illustration of FIGS. 10, 11 and 12 demonstrates how the selective release of different connections enables the same garment hanger 10 to be reshaped into another desired contour that will match a different garment. In this illustration the portion **44*a* of the strut 44 previously released and disconnected as discussed with respect to the illustration in FIGS. 7, 8 and 9 has again been disconnected and released in the present illustration of FIGS. 10, 11 and 12**.

In addition thereto, the strut 48 having shown to be disconnected or released from its engagement in the illustration of FIGS. 4, 5 and 6 is again shown released in the present illustration. Whereas the prior release of the strut 48 had permitted only the forward and rearward movement of the respective crossbars 34 and 26 of the front and rear sections 14 and 12 respectively, by the further release of the one portion **44*a* of the strut 44, it is now possible to enable the sloping flare supports 30 of the front section 14 to be bent forward as extended wings shown by the broken lines in FIGS. 10, 11 and 12**.

The selected release of the struts 48 and **44*a* also now releases and enables the rear flare extensions 24 to be bent rearward and also upward. The possibilities of movement and displacement permitted to be made by the flare extensions are only partially illustrated by the broken lines in FIGS. 10, 11 and 12. Obviously the flares 24 and 30** may be moved to any intermediate position if desired without breaking since the plastic wire-form construction permits such latitute of movements.

Figure 13:
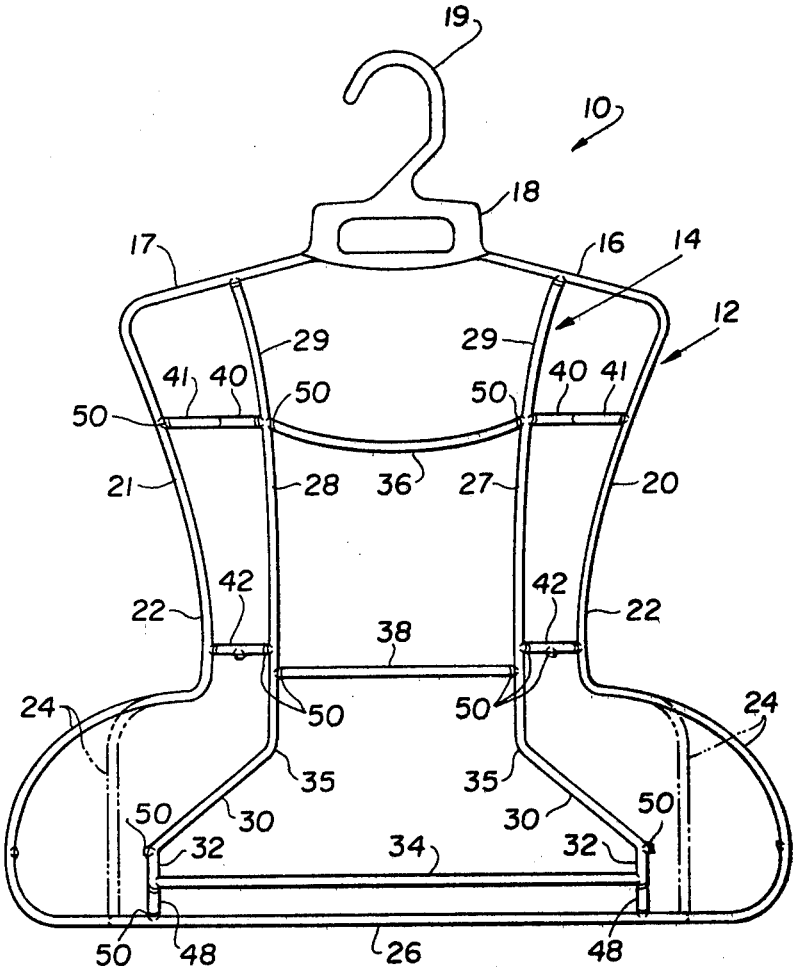
FIGS. 13, 14 and 15 illustrate front, side and bottom views respectively of another form into which the hanger may be changed following the release of a different combination of connections.
Figure 14:
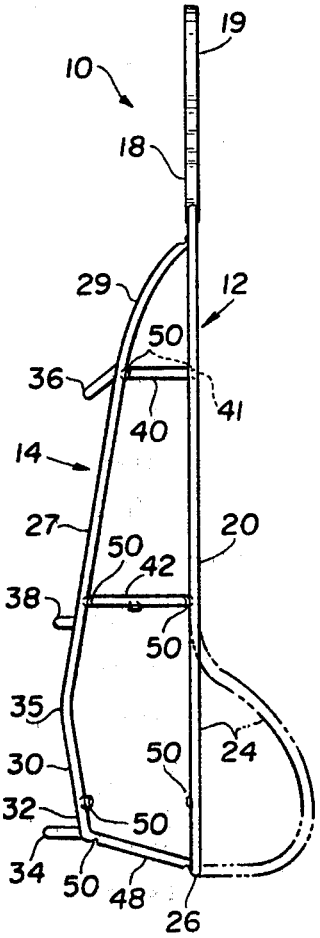
Figure 15:
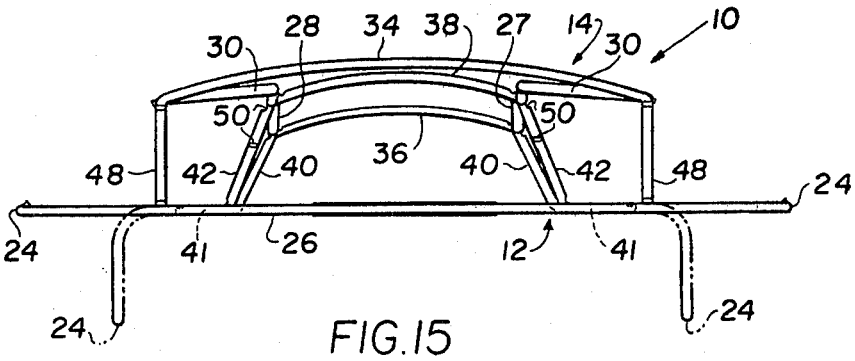

Reference is now made to the illustration of the present invention shown in FIGS. 13, 14 and 15 that demonstrates another manner in which the garment hanger 10 may be reshaped and changed into a different configuration by the selective release or removal of certain of the struts and other portions of the garment hanger so as to permit parts of the hanger to be moved, bent and changed from their originally molded shape. In this connection it will be seen that the illustration in FIGS. 13, 14 and 15 shows the elimination or release of the flare connecting strut 44 which includes the two strut parts 44*a* and 44*b* as illustrated more clearly in FIGS. 1, 2 and 3. The release of the entire two parts of the strut 44 also permits the release and removal of the intermediate flared section 46 from that shown in FIGS. 1, 2 and 3.

The release of the strut 44 obviously permits the laterally outward flared extensions 24 of the rear section 12 to be bent backward from their solid lines into a winged shaped configuration as is shown in broken lines in FIGS. 13, 14 and 15. As in all prior discussed illustrations, the solid line position of the movable parts is illustrated to enable the reader to recognize the original position of such part before it is able to be moved and changed in shape to its broken line position after the separation and/or release of the related struts, ribs and other connections.

In the present embodiment, the broken line position demonstrates the ability to move and bend the laterally outward flared extensions 24 of the rear section 12 from their solid line positions to their broken line positions so as to assume the shape of rearwardly bent wings over which a garment will be supported. When the skirt or lower portion of a garment is supported over such rearwardly bent wings 24, the garment will be flared by such wings rearward of the hanger 10 to attractively display the related details of such garment. Naturally, all bending and reshaping of the flared extensions 24 may be accomplished on the site where the garment is found and may be accomplished readily by reason of the wire-form construction of the flared extensions 24.

To aid the process of changing the shape of the hanger parts, they may be heated in hot water or under a heating lamp or any other warm medium so as to permit them to be bent readily into their desired reshaped position. Thereafter the parts may be cooled. When so cooled they will retain their reshaped positions until it becomes necessary to further change them to accommodate a differently flared garment.

Figure 16:
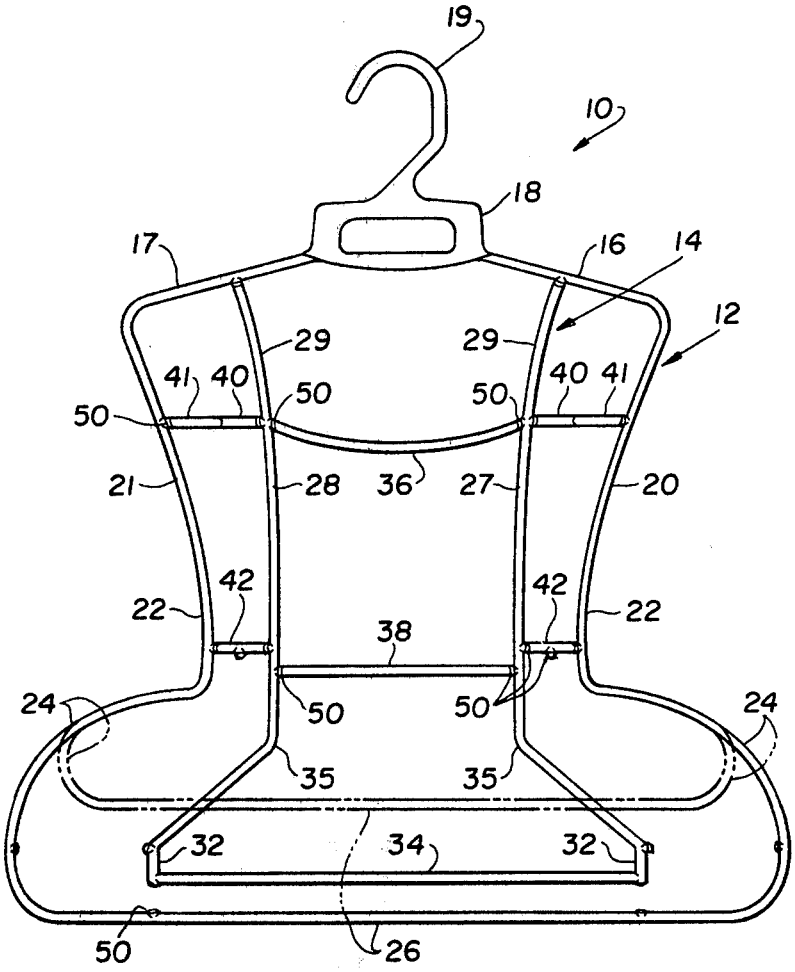
FIGS. 16, 17 and 18 illustrate front, side and bottom views respectively of still another shape the hanger of FIG. 1 may be made to assume.
Figure 17:
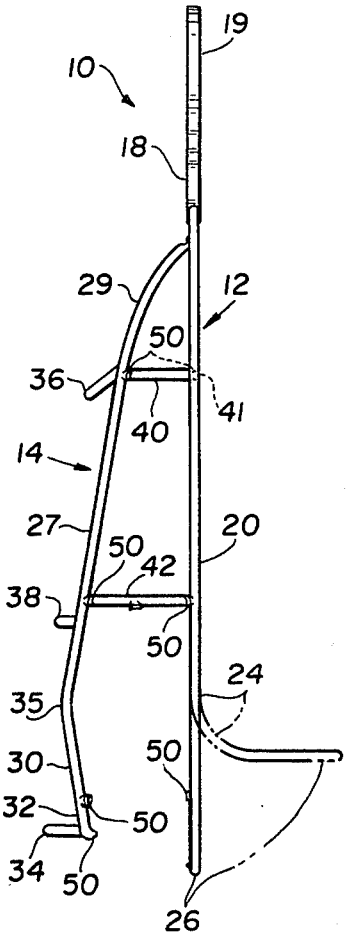
Figure 18:
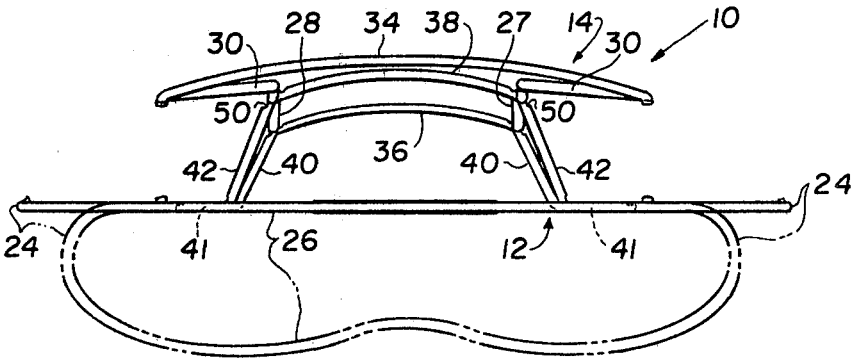

In referring to the illustration of FIGS. 16, 17 and 18, it will be seen that the same structural parts previously discussed may be further reshaped to form an entirely different changed configuration from the original molded shape of the garment hanger 10. This is accomplished by doing substantially what was discussed with respect to the illustration of FIGS. 13, 14 and 15. That is to say, assume in the present illustration that the flare connecting struts 44 have been released or fully separated as illustrated in the drawing from their connections between the flares 30 and 24. Also, the intermediate flared section 46 is illustrated as being fully removed in FIGS. 16, 17 and 18 as was discussed with the prior FIGS. 13, 14 and 15. However, in the present illustration the bottom connecting struts 48 are now shown to be released and totally removed (for ease of understanding) from their connections between the bottom closure crossbar 26 and the bottom closure crossbar 34.

As was described with respect to the prior illustration of FIGS. 13, 14 and 15, the release of the intermediate flared section 46 and of the connecting struts 44 permitted the flared section 24 to be moved rearward into a back wing changed configuration. However, by the removal or release of the bottom connecting struts 48, it is now possible to further completely change and reshape the bottom configuration of the garment hanger 10 at the front and rear sections 14 and 12, respectively. The solid line original positions of the flared portions of the front and rear section enable the viewer to recognize the position from which such members may be moved into their broken line positions as is also shown in FIGS. 16, 17 and 18.

For example, with the removal of the bottom connecting struts 48, the outer flared extensions 24 now may be moved, not only into the wing positions as was shown in FIGS. 13, 14 and 15, but also the whole lower portion of the rear section 12 may be moved rearward and upward into the broken line position as is shown in these FIGS. 16, 17 and 18. In like manner the release of the lower flared portion of the front section 14 by the removal or disconnection of the bottom connecting struts 48, now permits such lower flared portion comprising the flares 30, the sides 32 and the bottom closure bar 34 to be bent upward and forward from a point beginning at approximately the waist connecting struts 42.

Although this upward and forward movement or changed position is not illustrated in FIGS. 16, 17 and 18, it will be apparent to the reader that this is capable of being accomplished in the same manner as the flare extensions 24 of the rear section 12 are capable of being bent upward and backward along with their bottom closure bar 26. Therefore, it will be recognized by those who are skilled in the art that the mere additional release and/or removal of the bottom connecting struts 48 provides the present garment hanger with greater versatility of reshaping and change than was afforded by the mere release of the intermediate flared sections 46 and the flare connecting struts 44 as discussed with respect to FIGS. 13, 14 and 15.

The lower or bottom crossbar 26 may be provided with any lengthwise configuration such as the double bowed shape as is illustrated in FIG. 18. This double bowed shape or variations thereof also may be imparted to the bottom crossbar 34 of the front section 14 if so desired and needed for the purpose of attractively flaring and displaying the details of a garment mounted over the hanger 10.

Figure 19:
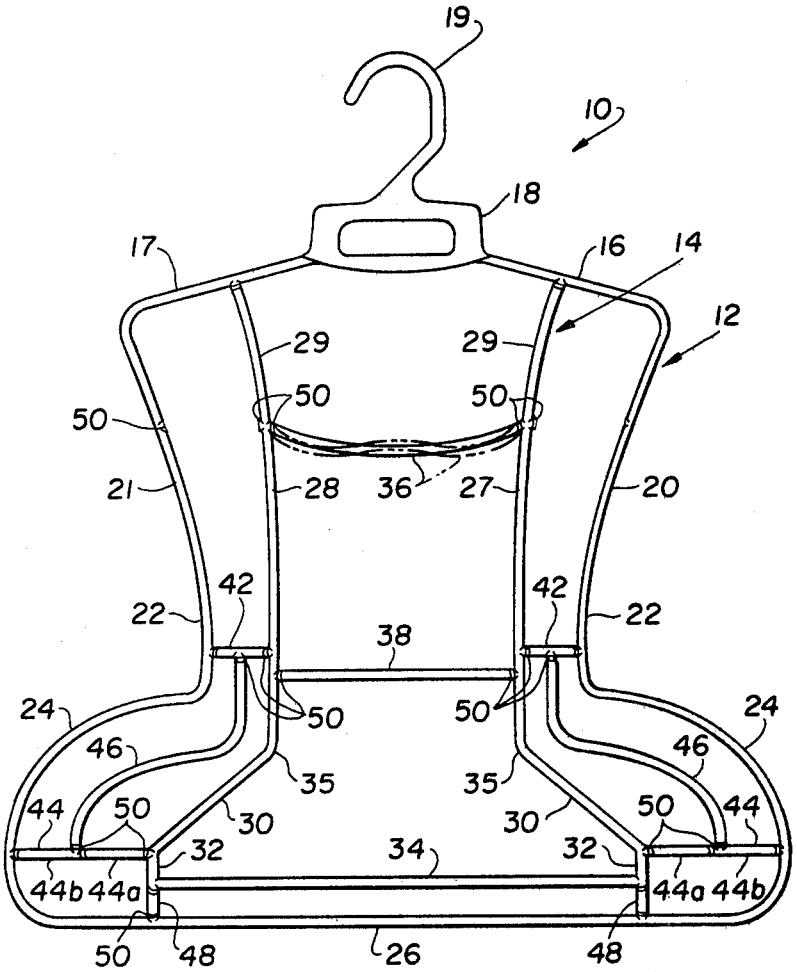
FIGS. 19, 20 and 21 are front, side and bottom views respectively showing how a hanger may be changed in shape at the chest and bust thereof.
Figure 20:
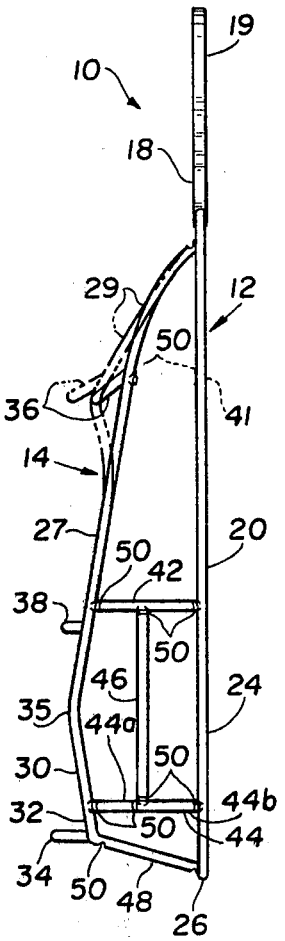
Figure 21:
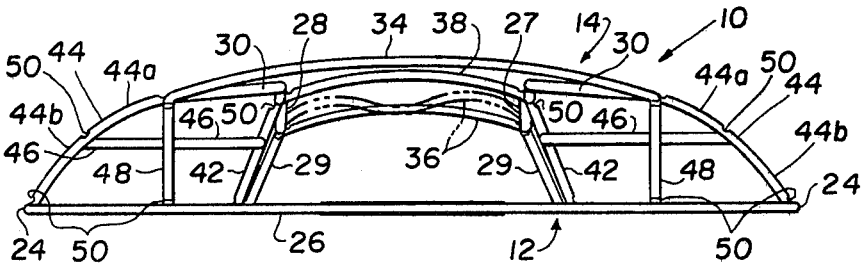

To demonstrate even further the versatility and ease of changeability of the shape of the original garment hanger 10 to accommodate a new garment thereon and to be able to reshape such garment hanger from its original molded configuration to that conforming to the new garment at the site of display of such garment, the garment hanger 10 illustrated in FIGS. 19, 20 and 21 is shown substantially similar to the garment hanger in its original molded shape as in FIGS. 1, 2 and 3, respectively. Except, however, that in the illustration of the garment hanger 10 in FIGS. 19, 20 and 21, the bust or chest connecting struts comprising the two legs 40 and 41 have been fully removed to illustrate their release from their connections between the sides 21 and 28 of the rear and front sections 12 and 14, respectively.

The struts 40, 41 as originally monolithically molded unitary with and as a part of the aforesaid sides, originally retained such sides substantially relatively fixed in relationship to each other. Although the struts 40, 41, as all the other struts of the present invention, retain their respectively connected portions from substantial relative movement, they do permit slight flexing of their connected portions because of the thinness of the struts themselves. However, upon the release of the connection of the struts 40, 41 from or with their respectively sides of their complete removal as is illustrated in FIGS. 19, 20 and 21 of the drawings, the sides 21 and 28 are now permitted relative movement as are sides 20 and 27.

As is illustrated more clearly in FIGS. 20 and 21, this now permits the outwardly bowed bust or chest sides 29 to be bent forward or rearward. It also permits the bust rib 36 to be reshaped because of the new flexibility and movement permitted the sides 27 and 28. One form of suggested movement is illustrated in broken lines in FIGS. 20 and 21 whereby the rib 36 and sides are shown as having been moved forward from their solid line originally molded shape to a new reshaped position wherein the same are positioned forward of and beyond the straight line position that they had assumed when they were originally molded.

Thus, it can be seen in FIGS. 20 and 21 that the bust or chest shaping rib 36 may be extended forward. It may also be provided with bust appearing separate protrusions **36*a* and 36*b* as is illustrated in FIG. 21 to accommodate the attractive details of a dress that might be positioned over the garment hanger 10 in which the dress may be designed for a larger size and more maturing young lady. Along with the reshaping of the rib 36, the bust shaping sides 29 and 28 may be similarly bowed forwardly as is illustrated in FIGS. 20 and 21** to meet and conform to the shape of the garment that may be positioned thereon.

From what has been described above, it should be apparent that the present invention teaches a unique arrangement of garment hanger structure in which the garment hanger is capable of being reshaped at the site of a garment to change the same to the shape of the garment so as to attractively display the details of such garment. In practice, it has been found that the connecting struts, ribs and intermediate flared sections 46 may be made of a very thin material so as to enable them to be released by breaking or interrupting them along their lengths or to remove them completely so as to permit the parts to which they are connected to move relative to each other.

It has also been found in practice that the points of connection between the struts and ribs and the related parts to which they are joined, as well as the intermediate flared sections 46, may be weakened or notched as at 50 so as to permit such struts, ribs and the intermediate flared section 46 to be broken completely free easily thereat by the application of finger pressure. By so providing for the simple release or disconnection of the struts, ribs and sections 46 from the remaining parts of the garment hanger by the simple application of finger pressure thereagainst, the need for expensive cutting tools is eliminated and completely avoided. It also permits a rapid disconnection and release of the supporting struts and section 46 without having to rely upon skills and tools that may be damaging to the garments if accidentally brushed thereagainst.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the invention, therefore, to be limited only as indicated by the scope of the claims appended hereto.

What is claimed is:

1. A reshapable three dimensional plastic garment hanger comprising:

rear and front garment hanger sections molded together to form an initial three dimensional shape which includes laterally directed shoulders and sides depending from each of said shoulders on said rear garment hanger section, said front garment hanger section including sides depending from and extending forward thereof and of said rear garment hanger section and defining the bust portion of the garment hanger corresponding in shape to that of the bust of a garment to be hung on said garment hanger, struts molded unitary with and releasably connecting said front and rear sections from undesired relative movement, said sections being flexible and relatively movable and said struts connecting said sections from undesired relative movement and in spaced relationship with selected ones of said struts being releasable to enable at least related released portions of said sections to be moved relative to each other from their molded fixed spaced relationship such that they may be selectively changed from their initial molded shape to a new shape corresponding to that of a different garment that is to be hung thereon at the site of display of such different garment so that the attractive details of said different garment hanger may be displayed thereon, and means on said garment hanger to suspend the same from a support.

2. A reshapable three dimensional plastic garment hanger as in claim 1, intermediate side supports between said spaced front and rear sections and connected between certain of said struts to reduce the space between said front and rear sections of said garment hanger to support a garment at said space between said front and rear sections, and said intermediate supports and certain of said struts connecting said front and rear sections being releasable to enable said sections to move forward and rearward relative to each other thereat thereby to permit said movable portions of said front and rear sections to be changed to a new shape different from that of their initial molded shape.

3. A reshapable three dimensional plastic garment hanger as in claim 2, said front and rear sections being molded monolithic and unitary with said struts and intermediate side supports from thermoplastic material with said intermediate sides and struts being relatively thin to permit the same to be removed selectively from between said sections.

4. A reshapable three dimensional plastic garment hanger as in claim 2, rib means releasably connecting said sides of at least one of said sections in their initial molded fixed spaced relationship against undesired relative movement and being releasable to enable said sides to move relative to each other from their initial molded relationship to be reshaped to correspond to the attractive details of a garment to be displayed thereon.

5. A reshapable three dimensional plastic garment hanger as in claim 4, said front garment hanger section being curved outward and extending in a direction away from said rear section and downward and forward of said shoulders to simulate the shape of a bust of a garment to be displayed thereon, and at least one of said rib means releasably connecting the spaced sides of said front section in the area of the bust shape to enable the release of said sides for relative movement and for reshaping of the bust of the garment hanger.

6. A reshapable three dimensional plastic garment hanger as in claim 2, said unitarily molded struts and sections being of wire-form so that the same are readily reshaped without breaking and are readily cooled to retain their reshape.

7. A reshapable three dimensional plastic garment hanger as in claim 1, said sections being of a thermoplastic material bendable and reshapable when heated for the purpose of changing the garment hanger from its initial molded shape to a new shape, and when cooled to retain said new shape.

8. A reshapable three dimensional plastic garment hanger as in claim 1, portions of weakened resistance defined on said garment hanger at least at the connections of said struts with said sections to enable said struts to releasably connect said sections.

9. A plastic garment hanger molded with an original three dimensional shape intended for the display of the attractive details of a garment thereon and being changeable to another shape in situ for the display of the attractive details of another garment thereon comprising relatively spaced front and rear garment shaping sections, a plurality of struts molded unitary for releasable connection with and between said shaping sections to retain the same in their spaced front and rear relationship and from substantial relative movement from their original molded three dimensional shape until such time as it is desired to change the shape of at least portions of said sections to correspond with and to display thereon another garment having attractive details different from that intended to be displayed on the original molded shape of the garment hanger, and said sections being relatively movable from their original molded fixed relationship upon the release of the connections therebetween of selected ones of said connecting struts to enable at least portions of said sections to be moved and changed at the site of the other garment to correspond to the shape and attractive details of the other garment so as to enable the same to be displayed thereon.

10. A plastic garment hanger as in claim 9, one of said shaping sections having relatively spaced depending sides, a plurality of ribs molded unitary with said depending sides and releasably connecting the same in their spaced relationship against relative movement to retain the same in their original molded three dimensional shape so that the release of the connections of selected ones of said ribs enable said sides to be moved out of their original shape and spaced relationship so as to enable a change of the shape of said sides of said garment hanger thereat.

11. A plastic garment hanger as in claim 10, said shaping sections, struts and ribs being originally molded with said sections as a unitary monolithic garment hanger.

12. A plastic garment hanger as in claim 9, said shaping sections being of a thermoplastic material which is bendable into a shape different from its original shape.

13. A method of making a three dimensional garment hanger that has an original molded shape for the display of one garment thereon and that is reshapable at the site of display of another garment comprising molding a monolithic plastic garment hanger with an original shape to display a garment thereon in which the garment hanger has shoulders supports and relatively spaced front and rear garment shaping sections depending from the shoulder supports and laterally spaced sides and including releasable connections between the front and rear sections and their respective sides to fix the sections and sides in their original respective three dimensional molded positions and shape and against relative movement, and selectively releasing certain of the connections to enable the released sections or sides to be moved from their originally molded fixed positions to new positions to reshape the same from their original molded shape to a new shape corresponding to another garment at the site of display of the other garment so as to enable the display of the attractive details of the other garment when the same is hung on the reshaped garment hanger.

14. A method as in claim 13, molding the garment hanger section of a thermoplastic material that is bendable and reshapable without breaking.

15. A method as in claim 14, heating the released sections prior to moving and reshaping the same, and cooling the reshaped sections to cause the same to retain their new shape.

16. A method as in claim 13, molding the releasable connections in a wire-form so the same may be bent and reshaped without breaking.

17. A method as in claim 13, molding the releasable connections with portions of weakened resistance to enable the release of said connections.

18. A method of making a three dimensional plastic garment hanger originally having one shape and reshapable to correspond to the shape of a garment at the side of display of the garment comprising molding the three dimensional garment hanger of a thermoplastic material with sections relatively spaced front and rear of each other and with each of said sections having spaced sides depending from a common garment shoulder support having means to suspend the garment hanger so that the relatively spaced molded front and rear sections and sides thereof have the original shape for the display of a garment, molding releasable connections in wire-form unitary with and connected between the front and rear sections at predetermined portions thereof to retain the sections fixed in position from substantial relative movement out of their original shape and in their relative spacing, releasing selected ones of the connections between the sections to permit movement of related portions of the sections relative to each other so as to enable the same to be reshaped from their original molded shape to a new shape corresponding to that of a garment to be displayed thereon, and reshaping the movable portions of the sections enabled by the release of the selected connections.

19. A method of making a reshapable three dimensional plastic garment hanger as in claim 18, said sections and spaced sides thereof being of wireform to enable the same to be moved into a new shape without breaking when the selected connections are released.

* * * * *

UNITED STATES PATENT AND TRADEMARK OFFICE

CERTIFICATE OF CORRECTION

PATENT NO. : 4,424,922

DATED : January 10, 1984

INVENTOR(S) : Jack M. Zuckerman and Andrew M. Zuckerman

It is certified that error appears in the above-identified patent and that said Letters Patent is hereby corrected as shown below:

Column 12, claim 13, line 17, "shoulders" should read --shoulder--

Column 12, claim 18, line 54, "side" should read --site--

Signed and Sealed this

*Fifteenth* Day of *May 1984*

[SEAL]

*Attest:*

GERALD J. MOSSINGHOFF

*Attesting Officer*

*Commissioner of Patents and Trademarks*